US005622477A

United States Patent [19]

Orth et al.

[11] Patent Number: 5,622,477

[45] Date of Patent: Apr. 22, 1997

[54] SWITCH FOR BILGE AND SUMP/PUMP WITH AUTOMATIC FLOAT CONTROL

[75] Inventors: Stephen R. Orth, Chicago; Burton L. Siegal, Skokie; Roman Buch, Libertyville, all of Ill.

[73] Assignee: Johnson Pumps Of America, Inc., Schiller Park, Ill.

[21] Appl. No.: 515,144

[22] Filed: Aug. 15, 1995

[51] Int. Cl.[6] ..... F04B 49/04

[52] U.S. Cl. ..... 417/40

[58] Field of Search ..... 417/40, 44.1; 318/139, 318/481; 361/111; 327/483

[56] References Cited

U.S. PATENT DOCUMENTS

| | | | |
|---|---|---|---|
| D. 306,447 | 3/1990 | Whitley, II . | |
| 2,844,678 | 7/1958 | Nielsen . | |
| 3,316,845 | 5/1967 | Schumann . | |
| 3,684,400 | 8/1972 | Einerson et al. . | |
| 3,717,420 | 2/1973 | Rachocki | 417/12 |
| 3,889,168 | 6/1975 | Onishi et al. | 318/341 |
| 3,999,890 | 12/1976 | Niedermeyer . | |
| 4,165,204 | 8/1979 | Nielsen . | |
| 4,186,419 | 1/1980 | Sims . | |
| 4,275,995 | 6/1981 | Taylor . | |
| 4,319,170 | 3/1982 | Brent | 318/376 |
| 4,345,879 | 8/1982 | Steiner . | |
| 4,510,425 | 4/1985 | Yokota et al. | 318/484 |
| 4,518,903 | 5/1985 | Matsumoto et al. | 318/481 |
| 4,805,066 | 2/1989 | Mergenthaler . | |
| 4,917,135 | 4/1990 | Duncan . | |
| 4,941,806 | 7/1990 | Brown et al. . | |
| 4,972,709 | 11/1990 | Bailey, Jr. et al. . | |
| 5,025,827 | 6/1991 | Weng . | |
| 5,155,311 | 10/1992 | Utke . | |
| 5,226,309 | 7/1993 | Stetter et al. | 73/31.06 |
| 5,260,641 | 11/1993 | Iwatani | 322/28 |
| 5,297,939 | 3/1994 | Orth et al. . | |

*Primary Examiner*—Timothy Thorpe
*Assistant Examiner*—Xuan M. Thai
*Attorney, Agent, or Firm*—Hill, Steadman & Simpson

[57] ABSTRACT

An improved switch for bilge and sump pumps which allows a manual override switch to be connected in the positive side of the power supply and which uses a reed switch actuated Darlington type circuit both of which are protected from reversed polarity connection by a current limiting resistor which is buffered with the protective resistor.

3 Claims, 2 Drawing Sheets

SWITCH FOR BILGE AND SUMP/PUMP WITH AUTOMATIC FLOAT CONTROL

CROSS-REFERENCES TO RELATED APPLICATIONS

This invention is an improvement on application Ser. No. 08/323,863 filed Oct. 17, 1994 entitled "Automatic Float Control Switch For A Bilge And Sump Pump" assigned to the assignee of the present invention in which the inventors are Stephen R. Orth and Burton L. Siegal.

BACKGROUND OF THE INVENTION

1. Field of the Invention

This invention relates in particular to a switch for bilge and sump pumps with automatic float control.

2. Description of the Related Art

This invention is an improvement upon the automatic control for bilge and sump pump U.S. Pat. No. 5,297,939 which issued on Mar. 29, 1994 in which the inventors are Stephen R. Orth and Burton L. Siegal which is assigned to the assignee of the present invention. FIG. 6 of U.S. Pat. No. 5,297,939 illustrates a transistor switching circuit that is switched on the negative side of the power supply which is generally grounded. FIG. 6 of U.S. Pat. No. 5,297,939 shows that in this arrangement, a manual override switch which is often desirable is placed in the negative side of the power supply. It is desirable for safety purposes to switch on the positive side of the power supply.

SUMMARY OF THE INVENTION

The present invention provides a switching circuit for an automatic float control for bilge and sump pumps which switches on the positive side of the power supply. The present invention protects from possible reverse polarity misconnection and uses a Darlington type circuit. It provides current limitation by using a resistor between a reed switch and the positive side of the power source.

The present invention provides a switching on the positive side of the power supply for both a manual override switch and a float control reed switch.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
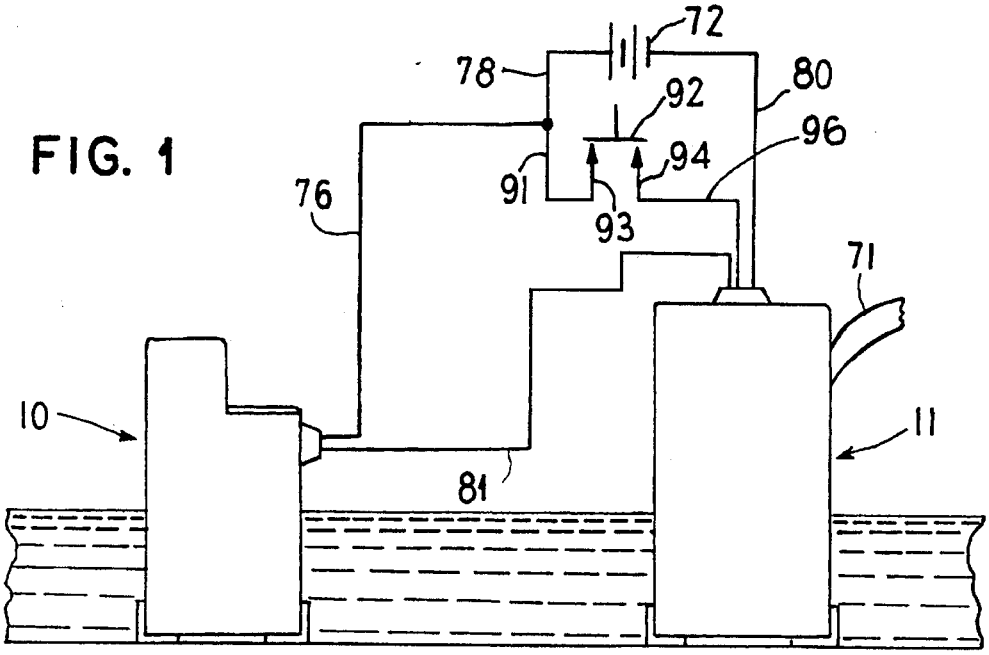
FIG. 1 illustrates the invention connected in circuit with the automatic float control for a bilge and sump pump disclosed in application Ser. No. 08/323,863.
Figure 2:
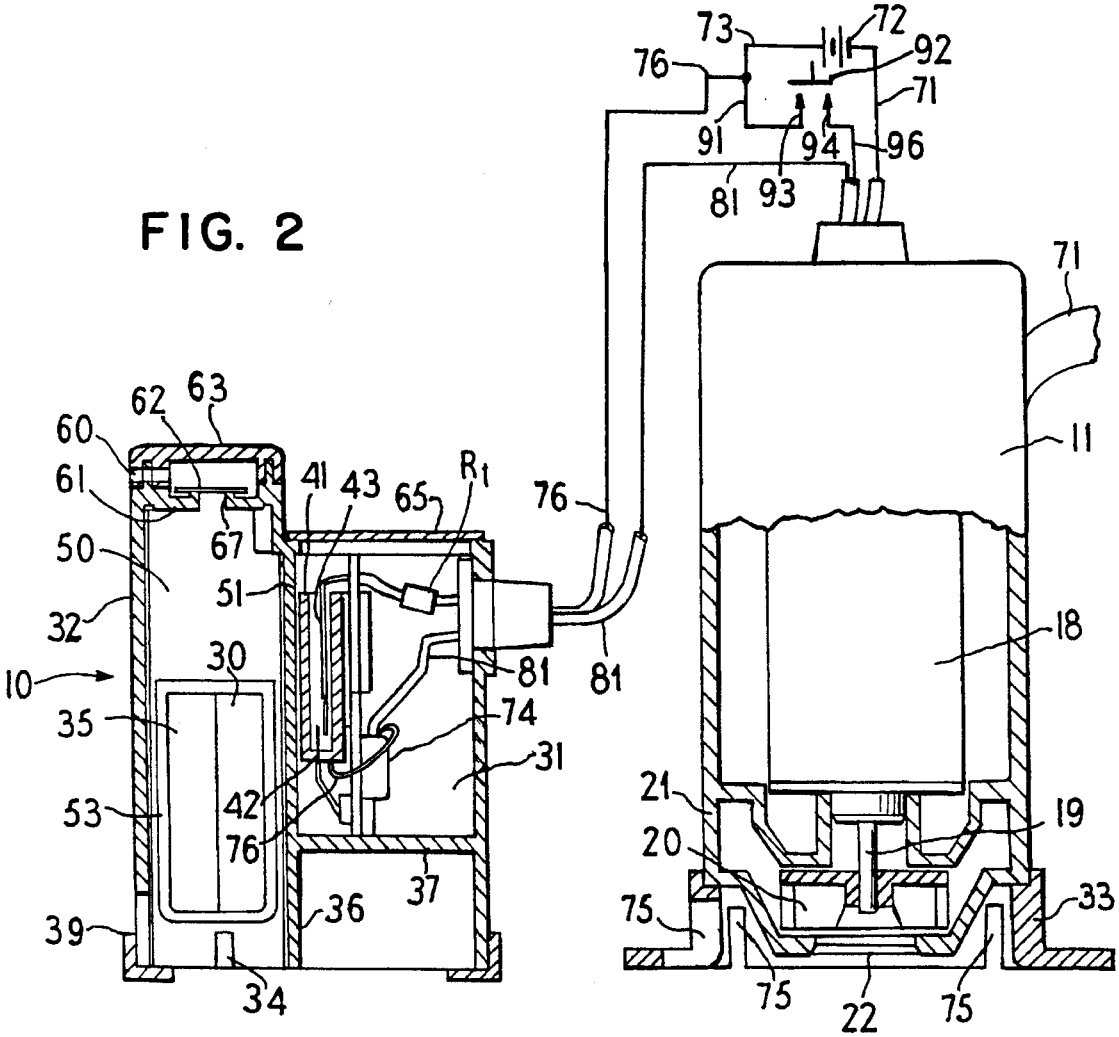
FIG. 2 is a partial sectional view of the apparatus of FIG. 1.

FIGS. 1 and 2 illustrate a pump 11 which as shown in FIG. 2 is driven by a motor 18 that has an output shaft 19 that drives an impeller 20 that is mounted in a chamber of its housing 21 into which liquid such as water can enter through opening 22. The pump 11 has a fluid outlet 71. Multiple slots 75 are formed in the base 33 so that water can pass to the opening 22. A mounting base 33 supports the housing 21.

A float switch 10 has a float chamber 50 and a switch chamber 31 and rests on a mounting base 39.

The float chamber 50 is similar to the float chamber described in U.S. Pat. No. 5,297,939 and has an enclosure 32 and includes a float 53 in which is mounted a permanent magnet 30. The remaining portion of the float 53 is filled with foam material or air 35. The float can move up and down in the float chamber 50 as liquid enters slot 34 in the enclosure 32. As the float 53 moves upward in the float chamber 50, air in the float chamber 50 passes out a one-way valve 62 mounted on the top end 61 of the float chamber 50. An opening 60 allows the air to escape through the side wall of a protective cover member 63 above the one-way valve 62. The switch chamber 31 is liquid tight sealed and separated by partition walls 36, 37 and 51 from the float chamber 50 and an ultrasonic sealed cover 65 in the switch chamber 31 supports a reed type switch 41 which has normally opened contacts 42 and 43 and that are closed when the float 53 moves sufficiently upwardly in the float chamber 50 so that the magnet 30 can close the contacts 42 and 43.

In U.S. Pat. No. 5,297,939, the float valve and switch housing was connected to the housing of the pump 11 and the present invention is applicable to the structure of U.S. Pat. No. 5,297,939 or the structure of Ser. No. 08/323,863 wherein the pump housing may be separated from the float valve and switch.

The pump 11 and float switch 10 are mounted so that their bottoms are close to the bottom of a boat or other chamber which is to be emptied. When water enters the slot 34 of the switch 10, the float 53 will move up in the float chamber 50 and air will be forced out of the chamber 50 through the one-way valve 62 and opening 60. When the permanent magnet 30 in the float 53 moves up so that it is adjacent the open switch contacts 42 and 43 and of the reed switch 41, the switch will close causing power to be supplied to the motor of the pump 11 so that the pump is actuated to discharge water through its discharge conduit 71. As the pump 11 removes the water from the bottom of a boat, the water level within float chamber 50 does not fall and the float 53 remains in the upper portion of the float chamber 50 due to a partial vacuum which exits in the chamber 50 of the float chamber because the one-way valve 62 does not allow air to enter the chamber 50 as the water level is lowered by the pump. The one-way valve 62 may be a soft elastomeric flapper cooperating with a valve seat 67. When the water level falls to the top of the water inlet slot 34, air can then enter through the slot 34 into the chamber 50, thus breaking the partial vacuum and allowing the water within it to run out through slot 34 so that the float will move downwardly in the float chamber 50 so that the magnet 30 is no longer adjacent the reed switch 41 and the reed switch will open which breaks the circuit to the pump motor 18. This stops the pump motor after substantially all the water has been removed from the boat or other chamber.

Figure 3:
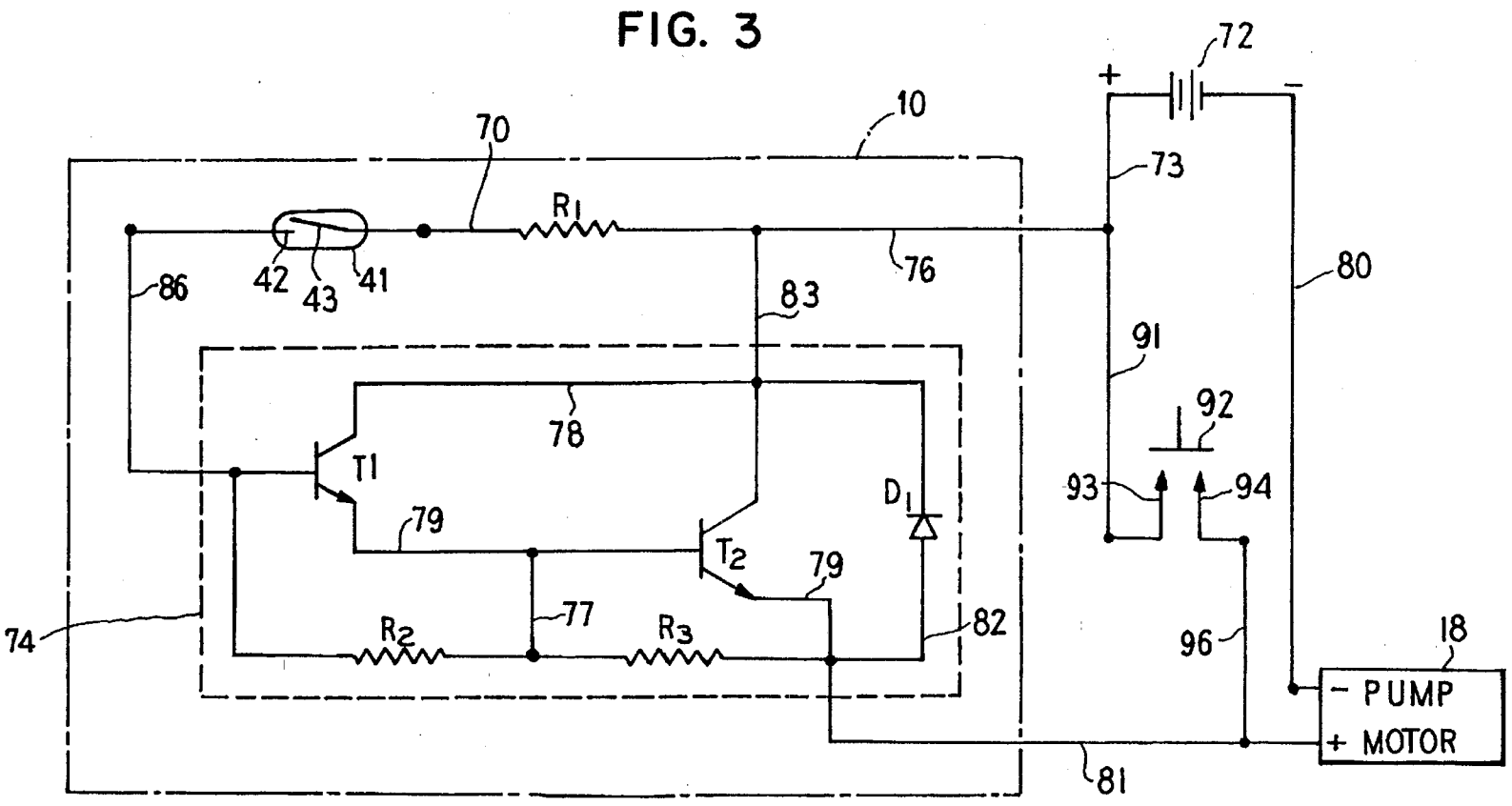
FIG. 3 is an electrical schematic illustrating the invention.

FIG. 3 illustrates the electrical schematic of the invention. In the preferred embodiment, a Darlington type power transistor 74 is illustrated showing its internal circuitry. A typical example of this type of power transistor is Motorola's TIP 140. A battery 72 has its positive terminal connected to a lead 73 and its negative terminal connected to a lead 80. The lead 80 is connected to the negative terminal of the pump motor 18. Lead 73 is connected to a lead 76 which is connected to a resistor R1 which has its other side connected to lead 70 that is connected to the movable contact 43 of the reed switch 41. The stationary contact 42 of the reed switch 41 is connected to lead 86 which is connected to the base of a transistor T1 within the Darlington type power transistor 74. The emitter of transmitter T1 is connected to a path 79 which is connected to the base of a second transistor T2. A resistor R2 has one side connected to the base of transistor T 1 and its other side connected by a path 77 to path 79 which is connected to the emitter of transistor T1. A resistor R3 is connected between the path 77 and the emitter of transistor T2 by a path 79. The path 79 is connected to a path 82 connected to diode D1 and to a lead 81 which is connected to the positive terminal of the pump motor 18. The diode D1 is connected between path 82 and path 78. The collector of transistor T2 is connected to path 78 and by lead 83 to lead 76. Path 78 also connects the collectors of transistors T1 and T2.

Figure 4:
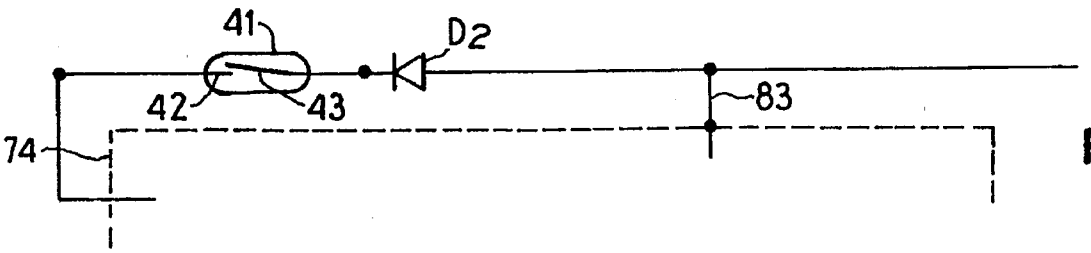
FIG. 4 is an alternate configuration of a portion of FIG. 3.

A normally open manual switch 92 has a first contact 93 which is connected to lead 91 which is connected to lead 73. A second contact 94 of switch 92 is connected by a lead 96 to the positive terminal of motor 18. In a preferred embodiment, resistor R1 had a value of 270 ohms, ¼ watt and provides current limitation protecting the reed switch contacts should leads 73 and 80 be accidentally reversed. In such case the pump motor 18 would run continuously until the circuit is broken. The power transistor 74 would be undamaged. In another embodiment, a diode D2 may be substituted for resistor R1 as shown in the partial circuit of FIG. 4.

Thus, the pump motor 18 can be manually energized by the manual switch contact 92 so as to apply positive power through leads 73, 91, contacts 93 and 94, and lead 96 and negative power through lead 80 to the motor 18. Alternatively, when the switch 92 is open, the pump motor 18 will be controlled by the reed switch 41 as disclosed in copending application Ser. No. 08/323,863 and U.S. Pat. No. 5,297,939.

It is seen that this invention provides an improved switching circuit for a bilge and sump pump so that a manual override switch can be connected of the power supply and so that positive side switching occurs. It is also tolerant of misconnection.

Although the invention has been described with respect to preferred embodiments, it is not to be so limited as changes and modifications can be made therein which are within the full intended scope of the invention as defined by the appended claims.

We claim as our invention:

1. A control for a pump motor comprising: a float switch including a reed switch, and a means for actuating said switch;

a battery with its negative terminal connected to a negative terminal of said pump motor, current limiting resistor with one one terminal connected to a positive terminal of said battery and with its other terminal connected to one of two contacts of said reed switch;

a transistor switching circuit connected between a positive terminal of said pump motor and said positive terminal of said batterv and actuated by said reed switch to energize said pump motor;

wherein said transistor switching circuit is a Darlington type comprising first and second transistors with a base of said first transistor connected to another terminal of said reed switch and a collector of said first transistor connected to a collector of said second transistor and to said positive terminal of said battery, an emitter of said first transistor connected to a base of said second transistor, and an emitter of said second transistor connected to said positive terminal of said pump motor; and a normally open manual pump motor start switch connected between said positive terminal of said pump motor and said positive terminal of said battery.

2. A control for a pump motor according to claim 1 including second and third resistors connected in series between the base of said first transistor and the emitter of said second transistor, and a junction point between said second and third resistors connected to the base of said second transistor, and a diode connected between the emitter and collector of said second transistor.

3. A control for a pump motor comprising: a float switch including a reed switch, and a means for actuating said switch;

a battery with its negative terminal connected to a negative terminal of said pump motor, a diode with one terminal connected to a positive terminal of said battery and with its other terminal connected to one of two contacts of said reed switch; a transistor switching circuit connected between a positive terminal of said pump motor and said positive terminal of said battery and actuated by said reed switch to energize said pump motor;

wherein said transistor switching circuit is a Darlington type comprising first and second transistors with a base of said first transistor connected to another terminal of said reed switch and a collector of said first transistor connected to a collector of said second transistor and to said positive terminal of said battery, an emitter of said first transistor connected to a base of said second transistor, and an emitter of said second transistor connected to said positive terminal of said pump motor; and a normally open manual pump motor start switch connected between said positive terminal of said pump motor and said positive terminal of said battery.

* * * * *

UNITED STATES PATENT AND TRADEMARK OFFICE

CERTIFICATE OF CORRECTION

PATENT NO. : 5,622,477

DATED : April 22, 1997

INVENTOR(S) : Orth et al

It is certified that error appears in the above-indentified patent and that said Letters Patent is hereby corrected as shown below:

Column 3, line 7, change "transmitter" to --transistor--.

Column 3, line 43, change "of" to --to--.

Column 4, line 1, delete "one".

Signed and Sealed this

Eighth Day of December, 1998

Bruce Lehman

*Attest:*

BRUCE LEHMAN

*Attesting Officer*

*Commissioner of Patents and Trademarks*